United States Patent [19]

McWhorter

[11] 4,108,119

[45] Aug. 22, 1978

[54] BOTTOM CYCLE MANIFOLD FOR FOUR-STROKE INTERNAL COMBUSTION ENGINES

[76] Inventor: Edward Milton McWhorter, 6931 Greenbrook Cir., Citrus Heights, Calif. 95610

[21] Appl. No.: 760,560

[22] Filed: Jan. 19, 1977

[51] Int. Cl.[2] ..... F02B 75/02

[52] U.S. Cl. ..... 123/75 C; 123/75 B; 60/307

[58] Field of Search ..... 123/75 C, 75 B, 22, 123/26; 60/307

[56] References Cited

U.S. PATENT DOCUMENTS

| | | | |
|---|---|---|---|
| 885,921 | 4/1908 | Griswold et al. | 123/75 C |
| 1,063,638 | 6/1913 | Batchelder | 123/22 |
| 2,123,302 | 7/1938 | Groth | 123/75 C |
| 3,583,375 | 6/1971 | Pischinger | 123/75 B |

FOREIGN PATENT DOCUMENTS

| | | | |
|---|---|---|---|
| 435,780 | 9/1935 | United Kingdom | 60/307 |

*Primary Examiner*—Wendell E. Burns

[57] ABSTRACT

The invention relates to new and useful improvements in the induction and exhaust processes of the four-stroke internal combustion engine. At the bottom of the induction stroke air is inducted through side-ports in the engine cylinder simultaneously with the induction of air or air-fuel charge through valves located in the combustion chamber. At the end of the expansion stroke, when the piston is once again at the bottom of its stroke, the combustion gases are partially exhausted through the same side-ports and partially through exhaust valves located in the combustion chamber which remain open throughout the exhaust stroke. The cylinder side-ports are manifolded in a manner which prevents serious exhaust gas contamination of the fresh air charge. Operating the engine in this manner improves the engine volumetric efficiency and reduces the normal pumping losses and also decreases the overall engine cooling requirements.

1 Claim, 5 Drawing Figures

BOTTOM CYCLE MANIFOLD FOR FOUR-STROKE INTERNAL COMBUSTION ENGINES

CROSS REFERENCE

The subject matter presented is similar to my copending Patent Ser. No. 583,155 filed June 6, 1975.

BACKGROUND OF THE INVENTION

FIELD OF THE INVENTION

The invention relates principally to the induction and exhaust processes of the four-stroke internal combustion engine. The characteristic bottom-cycle pressure schedule of four-stroke engines, operating on the Otto and Diesel cycle principles, are modified by the addition of cylinder side-ports which supplement the operation of induction and exhaust valves located in the combustion chamber.

DESCRIPTION OF PRIOR ART

Engines which incorporate cylinder side-ports are generally of the two-stroke type. Unlike four-stroke engine systems the two-stroke engine inducts air or air-fuel charges and also exhausts combustion gases when the piston is at or near the bottom-stroke position. For this purpose side-ports are placed along the cylinder wall at a location which approximately corresponds to a level above the piston crown when the piston is at the bottom-stroke position corresponding to the bottom-neutral center position of crank rotation. Because the induction and exhaust valves of four-stroke engines are located in the combustion chamber, the induction and exhaust processes of this type of engine are initiated and are terminated respectively when the piston is at or near the top-stroke position corresponding to the top-neutral center position of crank rotation.

I have discovered that by the incorporation of cylinder side-ports, hereinafter termed "side-ports", into the design of four-stroke engines very significant performance gains can be achieved. Because the proposed side-ports are used alternately for induction of air and the exhausting of combustion products there is a certain amount of contamination of fresh air charge and dilution of exhaust products occurring within the common manifolding system. Contamination is however, controlled within acceptable limits by the design of the size of the inlet and outlet ducts leading to and from the manifold. Therefore, in this respect the contamination of the fresh air charge with exhaust gases is somewhat similar to the contamination which occurs in most engine systems as a result of the overlap in the timing of the closing of the exhaust valve and the opening of the induction or inlet valve. In previous designs of engines which employ a common side-port manifold, i.e. a bottom-cycle manifold, used alternately for the introduction of a fresh charge to the cylinder and also for conducting away gaseous exhaust products, contamination of the fresh charge is prevented by the use of a sequencing valve which syncronously separates the inlet and exhaust circuits. The additional complication of a sequencing valve is not required in the engine design presented.

There are many advantages to the common bottom-cycle manifold. Exhausting at the end of the expansion stroke lowers the system pressure and therefore decreases the amount of pumping work required to push the remaining gases from the cylinder. Removal of hot gases through the cylinder side-port lowers the cooling requirements of the cylinder walls and also decreases the thermal load on exhaust valves in the combustion chamber which are prone to burn when very lean fuel mixtures are employed. The lower heat transfer rate at the cylinder walls also increases the life of the lubricating film.

The constant flow of a small amount of ambient engine environmental air through the common bottom-cycle manifold purges a preponderance of exhaust products from the said manifold and therefore prevents serious contamination of the air-fuel mixtures entering from the inlet valve above when the side ports are in communication with the cylinder swept volume during the induction stroke.

The addition of a slight amount of air through the side-ports during induction and the cooling effect obtained from the additional internal ventillation also increase the engine volumetric efficiency.

SUMMARY OF THE INVENTION

The primary object of this invention is to provide in a manner hereinafter setforth a common manifold for the addition of air to the engine combustion chamber through cylinder side-ports during the period when the piston is at the bottom of the induction stroke, and also, for conducting combustion gases away from the engine through the same side-ports when the piston is at the bottom of the expansion stroke.

Another very important object of the invention is to lower the cooling requirements of the engine cylinder and to decrease the thermal loads on the exhaust valve.

And yet another object of the invention is to provide a manifold for the induction of air into the combustion chamber and thus increase the volumetric efficiency of the engine system.

And still another object of the invention is to provide a bottom-cycle manifold which will allow the engine to breath easier and thus reduce pumping loses under heavy loads.

All of the foregoing and still further objects and advantages of the invention will become apparent from a study of the drawings and specification presented.

BRIEF DESCRIPTION OF THE DRAWINGS

There are included as part of the specification, drawings which show the design and construction of the bottom-cycle manifold and its general operation throughout the engine cycle.

DESCRIPTION OF THE PREFERRED EMBODIMENT

Figure 1:
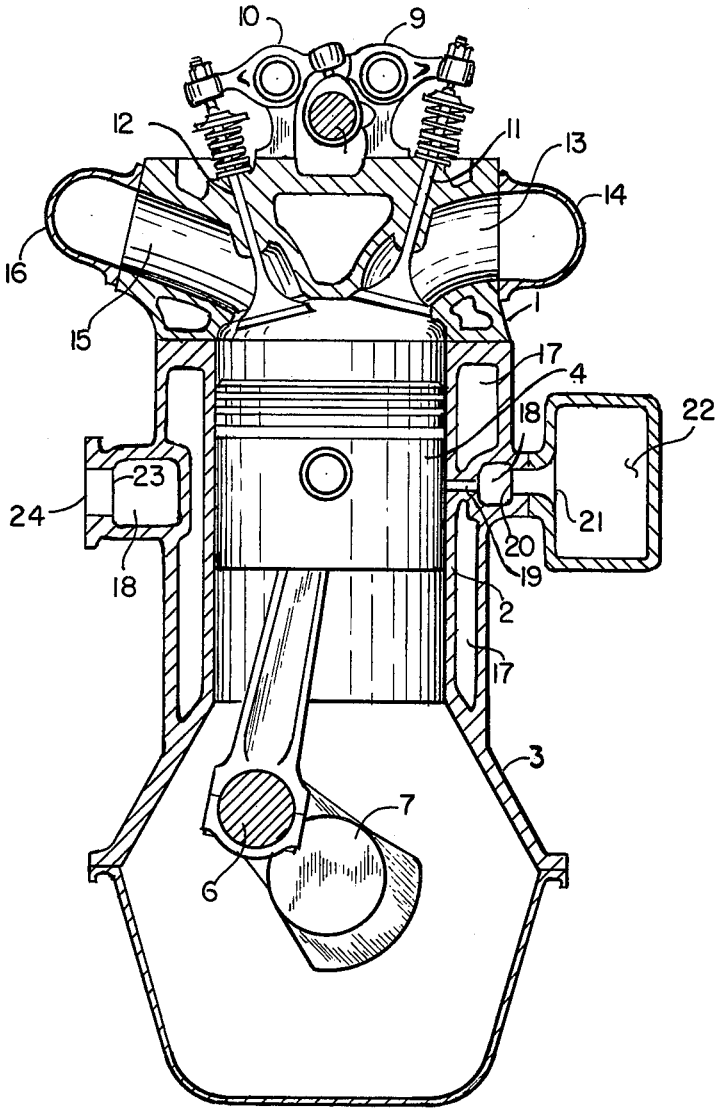
FIG. 1 is a drawing of an engine showing the cylinder and crankcase principally in cross-section with the bottom-cycle manifold shown attached to the lower portion of the cylinder.

Referring now to the drawings in detail and to FIG. 1 thereof in particular. FIG. 1 is a cross-sectional drawing of a cylinder head 1, cylinder 2, and crankcase 3 of an engine having a plurality of such cylinders. Piston 4 is slidably mounted in cylinder 2. Connecting rod 5 is pivotally mounted in piston 4 at one end and rotatively mounted to crankpin 6 at the other end. The rotation of crankshaft 7 within journals fixedly attached to crankcase 3 will cause piston 4 to rise and fall within cylinder 2 in a reciprocating motion which is typical of all piston driven engines.

Camshaft 8 is connected to crankshaft 7 by a gear train or by a chain/belt and sprocket/pully assembly which is not shown. The connection between these two shaft components is such that one complete revolution of the crankshaft 7 casues only one-half a revolution of camshaft 8 which is typical of all engine systems which operate on the four-stroke principle.

Camshaft 8 bears upon rockers 9 and 10 which in turn open and close inlet valve 11 and exhaust valve 12 which in turn respectively control the flow through inlet port 13 and exhaust port 15. Inlet port 13 opens into inlet manifold 14 and exhaust port 15 opens into exhaust manifold 16. Water coolant passages through cylinder head 1 and cylinder 2 are designated at their various locations by the character 17. The method of external engine cooling is not pertinent to the discussion in this respect since an air-cooled version of the same engine would function equally as well.

The novelty of the engine system described above is manifold 18 which is brought into communication with the swept volume of cylinder 2 and the combustion chamber clearance volume under cylinder head 1, through side-ports 19 when the piston 4 is at or near the bottom stroke position as shown in FIG. 1. Because side-ports 19 are located at the lower end of cylinder 2 at a position which is slightly above piston 4 crown when piston 4 is at the bottom stroke position, where the various cycle pressures are lowest, the manifold 18 is designated as a bottom cycle manifold to distinguish it from the ordinary inlet manifold 14 and exhaust manifold 16 which are common to all four-stroke engine systems. Other elements of manifold 18 are, air inlet 20, air inlet duct 21 and pressurized air source 22. On the opposite side of manifold 18 are located exhaust outlet 23 and exhaust duct 24.

Manifold 18 may be of any convenient configuration which best suits the flow conditions of the particular engine system. In FIG. 1 manifold 18 is shown as a torus having a square cross-section. It is generally recognized by those skilled in the art that a circular cross-section would present a lower volume to surface area and would therefore offer less contact and thus less resistance to gas flow. These are, however, detail considerations which effect only the efficiency of the system rather than its general nature. In a similar manner, the side ports 19 may be round, square, or rectangular and may be located only in the area in front of the air inlet 20 or dispersed about the entire perimeter of the cylinder. Needless to say, manifold 18 need not be a complete torus if side-ports 19 are only located in one area on the cylinder. Another example of design variability which does not effect the novelty of the invention is the air pressure source 22. Air pressure for the operation of manifold 18 may be from any source in which the pressure difference accross the air inlet 20 is sufficient to supply the necessary flow conditions of the particular engine. These conditions are approximately satisfied when the pressure in air inlet 20 is about 1 psi higher than in manifold 18 when ports 19 are closed. Higher differential pressures across air inlet duct 20 would of course increase the purging efficiency and would decrease the amount of reverse flow of contaminating exhaust gases entering through air inlet 20 when side-ports 19 are uncovered at the end of the expansion stroke.

Figure 2:
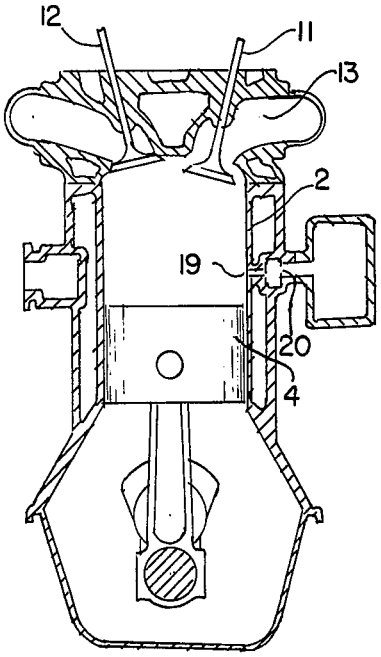
FIGS. 2 through 5 are diagramatic illustrations of the four-cycle operation of the engine system employing the bottom-cycle manifold.

Turning now to FIGS. 2 through 5 which are diagramatic illustrations of the engine operation showing the piston 4 at the top and bottom stroke positions throughout the four-stroke cycle. FIG. 2 shows the piston 4 at the bottom stroke position at the end of the induction stroke. During the downward stroke the inlet valve 11 is open, as shown, allowing air or air-fuel mixtures to enter cylinder 2 through inlet-port 13. As piston 4 drops below side-ports 19 air also enters cylinder 2 from air-inlet 20. It should be noted that only air enters through air-inlet 20 and that all fuel is supplied to the engine either from inlet-port 13 or from a fuel injector positioned in the combustion chamber.

It is desireable to have air enter from the lower cylinder side-ports 19 for a variety of reasons. During the induction stroke the cylinder pressure will vary between 5 psia to 10 psia, depending on the engine operating conditions. The addition of air from air-inlet 20, which is pressurized at about 15 psia, allows more air to be inducted into cylinder 2 and thus increases the engine volumetric efficiency in a manner similar to supercharging. Air entering from this position in the cylinder 2 also has a cooling effect on the exposed heated piston 4 and cylinder 2 working surfaces. This tends to decrease the amount of heat added to the air-fuel charges being inducted from above and this also improves the engine volumetric efficiency.

Figure 3:
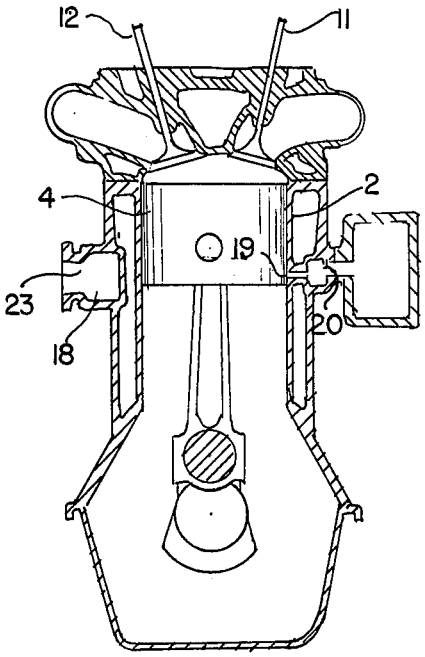

At the end of the induction stroke the piston 4 returns to the top-stroke position to complete the compression stroke as shown in FIG. 3. During the upward motion of piston 4 to the top stroke position both inlet valve 11 and exhaust valve 12 are closed. Air continues to enter manifold 18 from air inlet 20. Air circulating through manifold 18 is prevented from entering cylinder 2 by piston 4 skirt which closes side-ports 19. The circulating air therefore exits manifold 18 through exhaust-outlet 23.

Figure 4:
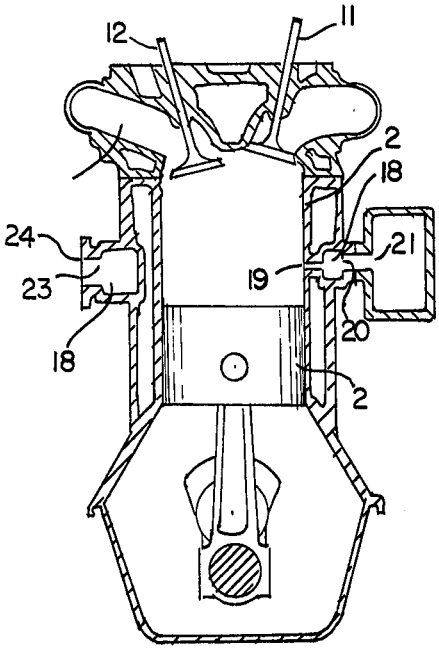

Turning now to FIG. 4, the piston 4 is shown at the bottom stroke position at the end of the expansion stroke. Piston 4 has uncovered side-ports 19 which places manifold 18 in communication with the cylinder 2. Exhaust gases, which are pressurized between 20 psia to 50 psia, depending on the engine operating conditions, flow from cylinder 2 through side-ports 19 and presurize manifold 18. Exhaust gases are also exiting cylinder 2 through exhaust port 15 during this period. Exhaust gas pressures in manifold 18 may exceed the air pressure in air-inlet duct 1 and therefore exhaust gases will back up into this section contaminating the air in the duct 20. These, however, will be purged out on the subsequent exhaust and induction strokes and is no more of a concern than contamination occuring in most standard engines as a result of valve timing overlap or exhaust manifold back pressures. The contamination of air-inlet duct 21 is reduced, to a certain amount, by designing the exhaust-outlet 23 appreciably larger than air-inlet 20 such that the greatest portion of exhaust gases entering manifold 18 exit the system immediately through exhaust duct 24. Other features which tend to limit the amount of exhaust gas contamination is the somewhat higher air-inlet 20 pressure which is about 15 psia when compared to that at exhaust-outlet 23 at about 14.7 psia and also to the fact that manifold 18 may be designed as a constant velocity manifold which will accelerate exhaust gases toward exhaust-outlet 23. In this latter consideration side-ports 19 are displaced toward air-inlet 20 in a manner such that exhaust gas flow accelerates towards the increasing manifold flow area in accordance with the Bernoulli relationship. The inertial effects of the accelerating stream also assist in maintaining flow toward exhaust-outlet 23 after side-ports 19 are closed.

Figure 5:
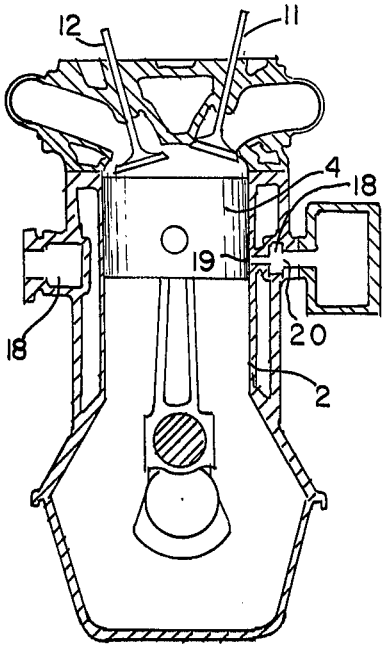

Looking now at FIG. 5 which shows piston 4 once again at the top stroke position. In this instance it is at the end of the exhaust stroke. Exhaust valve 12 is open and the remaining exhaust gases are being pushed from cylinder 2 by piston 4. Also during this period exhaust gases are being purged from the general area of side-ports 19 by air flowing through air-inlet 20 thus preparing the manifold 18 for the subsequent induction stroke shown in FIG. 2 and previously discussed.

What is claimed is:

1. A four-stroke cycle piston driven internal combustion engine, said engine containing a plurality of cylinders fixedly attached to a crankcase, poppet valves for the induction of air-fuel charges into said cylinder, said poppet valves being located in combustion chambers above said cylinders, poppet valves for the exhausting of combustion gases from said cylinders also located in said combustion chambers, pistons slidably mounted within said cylinders, connecting rods pivotally mounted in said pistons at one end and rotatively mounted on crankpins at the other end, aligned arms fixedly attached to each end of said crankpins, opposing said arms between said crankpins being fixedly attached to each end of axially aligned shafts forming a plurality of crank throws of a crankshaft, said crankshaft being rotatively mounted in journals in said crankcase, a plurality of side ports in said cylinder walls at a level which is above the face of said pistons when said pistons are at the bottom of their stroke, a manifold connecting said side-ports, a duct opening into said manifold leading directly to a pressurized air source, another duct opening in said manifold leading directly to ambient atmosphere.

* * * * *